US006361373B1

(12) United States Patent
Horchler

(10) Patent No.: US 6,361,373 B1
(45) Date of Patent: Mar. 26, 2002

(54) MICRO MINIATURE ELECTRICAL CONNECTOR AND METHOD OF MANUFACTURE

(75) Inventor: David C. Horchler, Millersburg, PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/351,113

(22) Filed: Jul. 10, 1999

Related U.S. Application Data

(62) Division of application No. 09/126,366, filed on Jul. 30, 1998, now Pat. No. 5,980,325.

(51) Int. Cl.[7] ..... H01R 13/502
(52) U.S. Cl. ..... 439/701; 439/752
(58) Field of Search ..... 439/701, 752, 439/79

(56) References Cited

U.S. PATENT DOCUMENTS

| | | | | |
|---|---|---|---|---|
| 4,045,114 A | | 8/1977 | Dechelette | 339/210 M |
| 4,147,399 A | | 4/1979 | Moser et al. | |
| 4,775,333 A | | 10/1988 | Grider et al. | 439/736 |
| 4,822,303 A | | 4/1989 | Nakamura et al. | 439/607 |
| 5,190,482 A | | 3/1993 | VanDerStuyf et al. | 439/686 |
| 5,190,483 A | * | 3/1993 | Viselli | 439/752 |
| 5,244,420 A | | 9/1993 | Lopata | 439/699 |
| 5,344,327 A | | 9/1994 | Brunker et al. | 439/108 |
| 5,419,720 A | | 5/1995 | Chen | 439/676 |
| 5,511,984 A | | 4/1996 | Olson et al. | 439/79 |
| 5,573,430 A | | 11/1996 | Hatagishi | 439/701 |
| 5,580,283 A | | 12/1996 | O'Sullivan et al. | 439/686 |
| 5,643,005 A | | 7/1997 | Weidler et al. | 439/405 |
| 5,658,164 A | | 8/1997 | Parker | 439/495 |
| 5,718,599 A | | 2/1998 | Ichikawa et al. | 439/404 |
| 5,766,033 A | | 6/1998 | Davis | 439/405 |

FOREIGN PATENT DOCUMENTS

EP 0 606 739 A2 7/1994

* cited by examiner

*Primary Examiner*—Gary Paumen
(74) *Attorney, Agent, or Firm*—Perman & Green, LLP

(57) ABSTRACT

A micro miniature electrical connector element which is manufactured by first providing an axial insulative member having a conductive terminal retaining means. An insulative housing which has a peripheral wall and an axial opening is also provided. The axial insulative member is inserted into the axial opening such that the conductive terminal is fixed in the conductive terminal retaining means. This connector is non-barbed and is manufactured without insert molding.

21 Claims, 14 Drawing Sheets

MICRO MINIATURE ELECTRICAL CONNECTOR AND METHOD OF MANUFACTURE

This application is a division of application Ser. No. 09/126,366, filed Jul. 30, 1998.

BACKGROUND OF THE INVENTION

1. Field of the Invention

The present invention relates to electrical connectors and more particularly to methods of manufacturing micro miniature electrical connectors. 2. Brief Description of Prior Developments Conventional means for locking terminals into their plastic housings include stamped barbs that dig into the dividing plastic walls to provide the required terminal retention. Other such means include plastic latches, embossed terminal geometry that presses into a plastic cavity, protruding metal that catches a plastic wall, and the like.

As connector development moves further towards miniaturization, the space for plastic walls and ledges between terminals becomes reduced to the point that there is not sufficient size and structure available for these conventional approaches.

As a result, many miniaturized connector designs are achieving terminal retention by way of an insert molding process where the molten resin flows around the terminals geometry during the molding operation of the connector building process. Although this method is effective, it is also expensive due to the slow molding cycle times as a result of the need to load and manage the individual or segmented terminals. A process that includes traditionally molded housings that receive terminals in a subsequent operation can normally be more cost effective.

A need, therefore, exists for a low cost non-barbed connector that an be manufactured without insert molding which maintains functional characteristics of the prior art barbed, insert molded connectors.

SUMMARY OF THE INVENTION

The present invention is a micro miniature electrical connector element which is manufactured by first providing an axial insulative member having a conductive terminal retaining means. An insulative housing which has a peripheral wall and an axial opening is also provided. The axial insulative member is inserted into the axial opening such that the conductive terminal is fixed in the conductive terminal retaining means. This connector element is non-barbed and may be manufactured without insert molding.

BRIEF DESCRIPTION OF THE DRAWINGS

The present invention is further described with reference to the accompanying drawings in which:

FIG. 24 is an assembled top front perspective view of the connector element shown in FIG. 12 wherein FIG. 12 is taken through 12—12 in this figure.

DETAILED DESCRIPTION OF THE PREFERRED EMBODIMENTS

Figure 1:
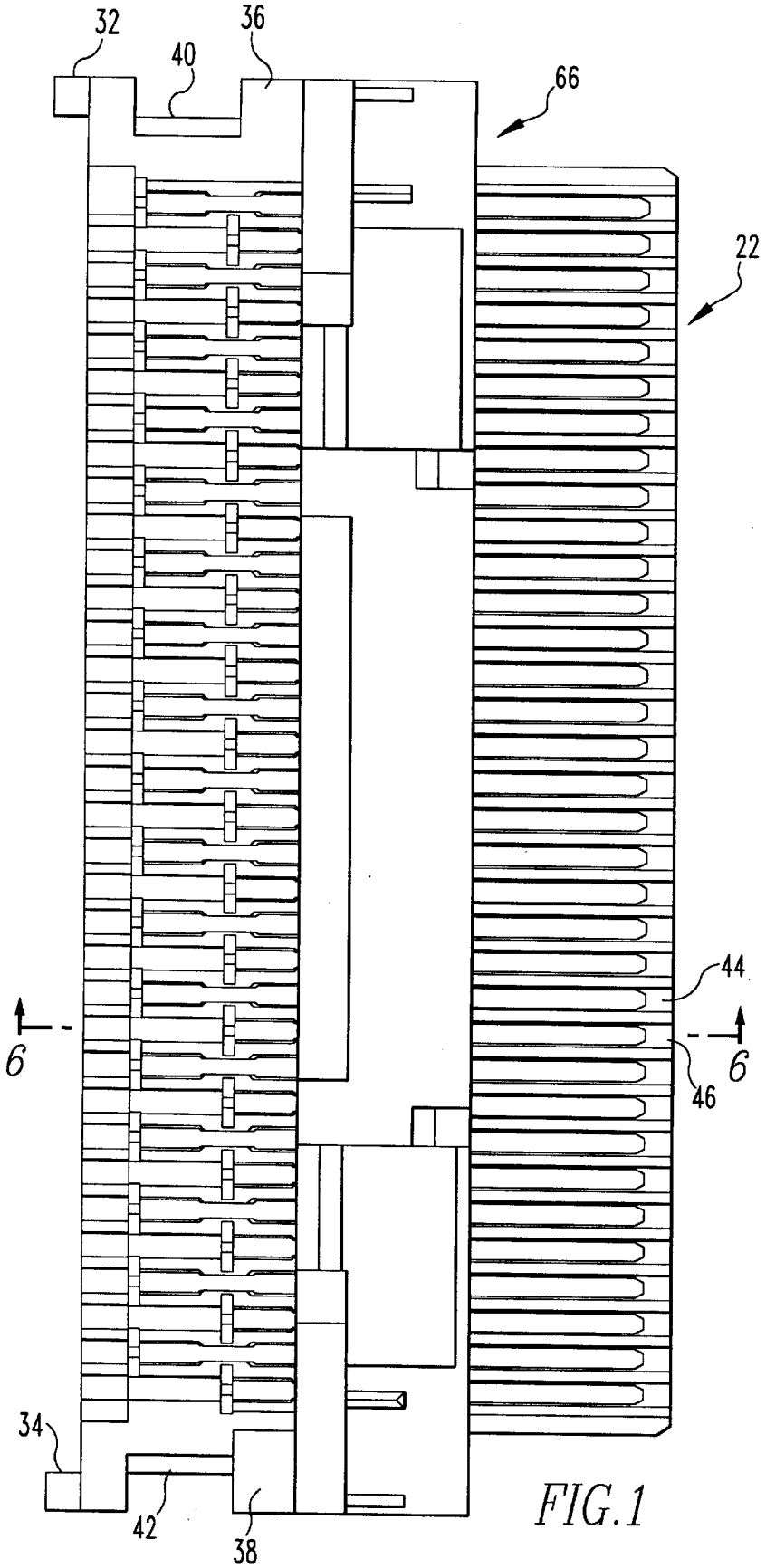
FIG. 1 is a top plan view of a preferred embodiment of the micro miniature connector of the present invention.
Figure 2:
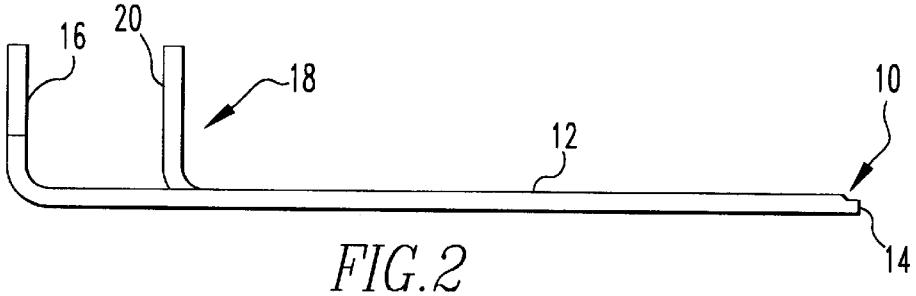
FIG. 2 is a side view of a conductive terminal used in the connector shown in FIG. 1.
Figure 3:
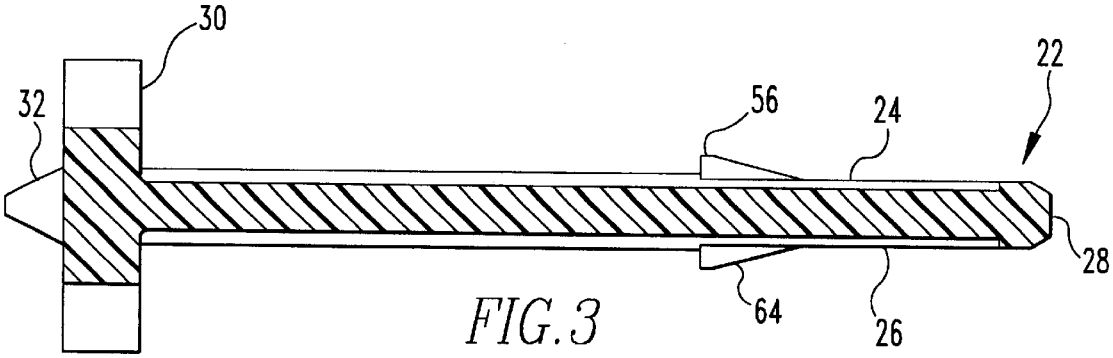
FIG. 3 is a cross sectional view of an axial insulative member used in the connector shown in FIG. 1.

A plug used in a preferred embodiment of the connector of this invention is shown in FIGS. 1–11. Referring particularly to FIG. 2, a pair of terminals used in this connector is shown. A first terminal is shown generally at numeral 10, and this terminal has an axial section 12*a* forward end 14 and a rear perpendicular insulation displacement contact (IDC) extension 16. The second terminal is positioned directly behind terminal 10 and is shown generally at numeral 18. This terminal is shorter than terminal 10 and has a rear perpendicular IDC extension 20 which is spaced from IDC extension 16 on terminal 10.

Figure 4:
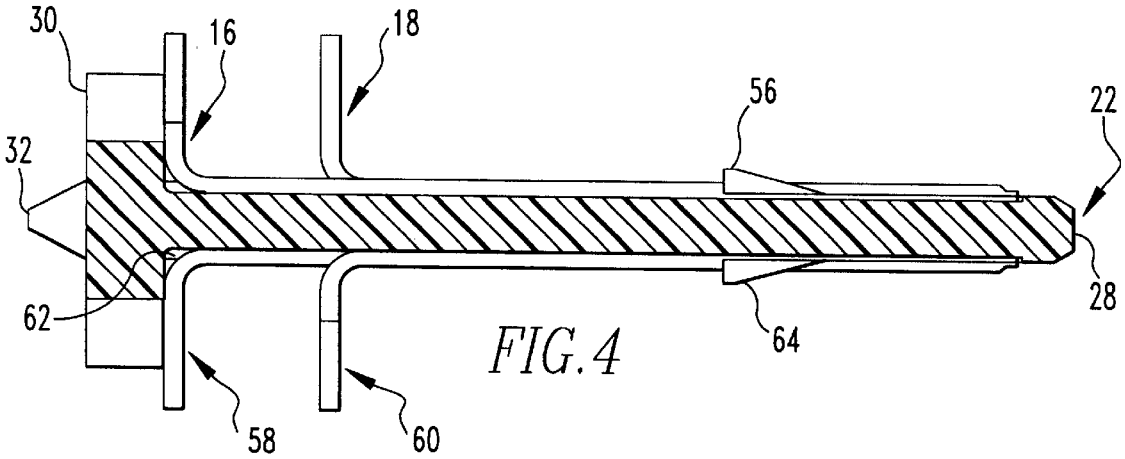
FIG. 4 is the axial insulative member shown in FIG. 3 on which a plurality of terminals as is shown in FIG. 2 are mounted.
Figure 5:
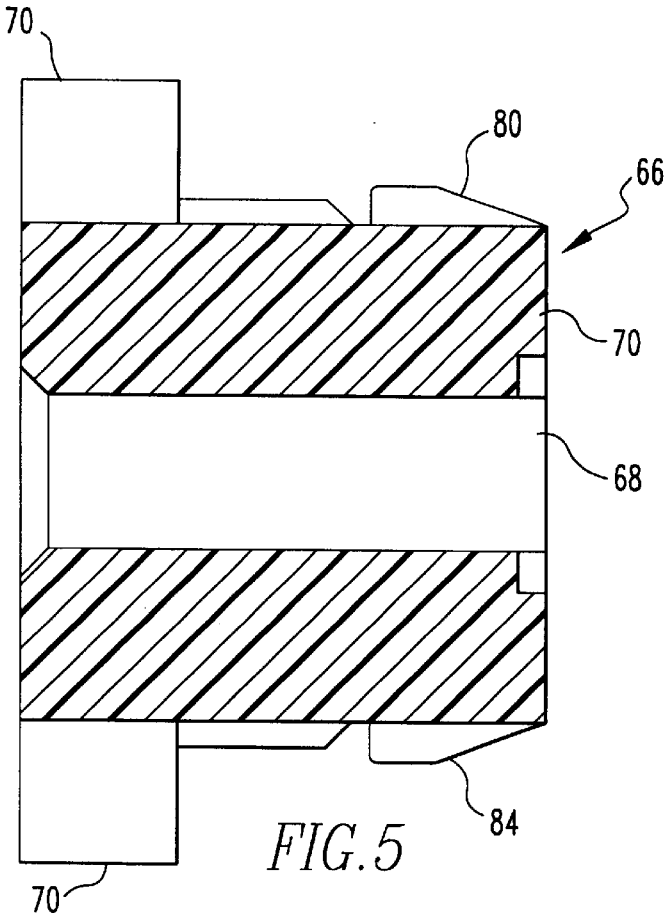
FIG. 5 is an insulative housing in which the axial insulative members and terminals shown in FIG. 4 may be mounted.
Figure 11:
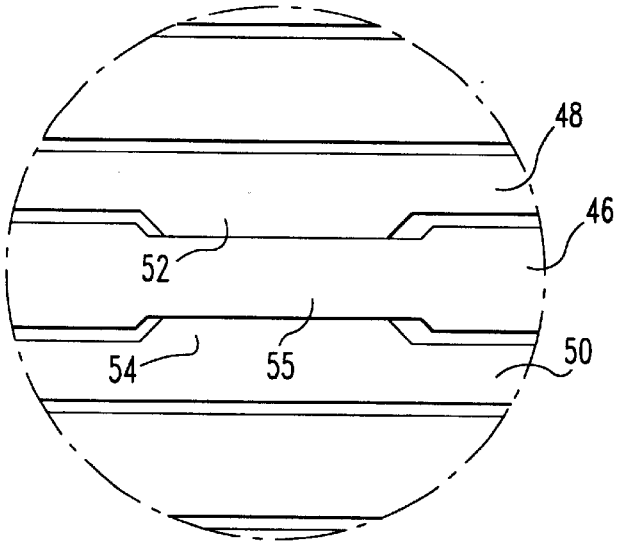
FIG. 11 is a detailed view of circle 11 in FIG. 8.
Figure 6:
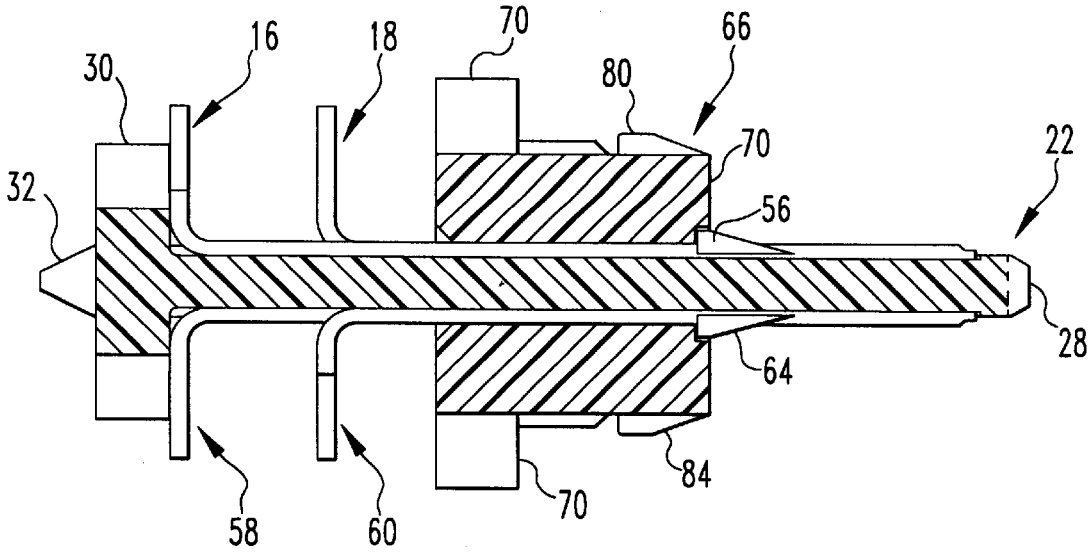
FIG. 6 is a cross sectional view through 6—6 in FIG. 1 showing the axial insulative members and terminals shown in FIG. 4 as mounted in the housing shown in FIG. 5.
Figure 7:
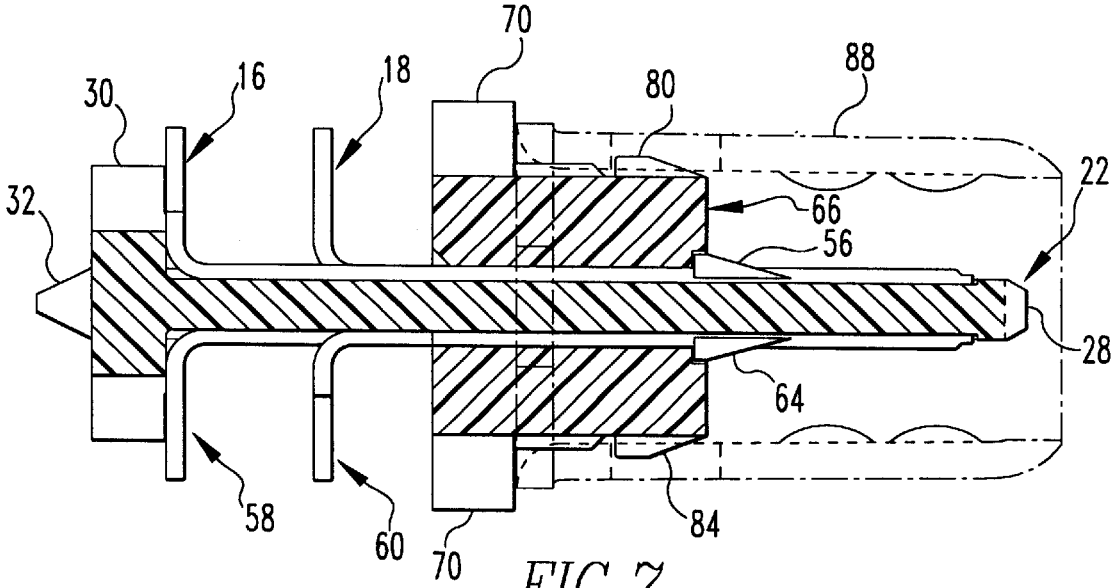
FIG. 7 is a cross sectional view similar to FIG. 6 in which a metallic shell is additionally mounted on the connector.
Figure 8:
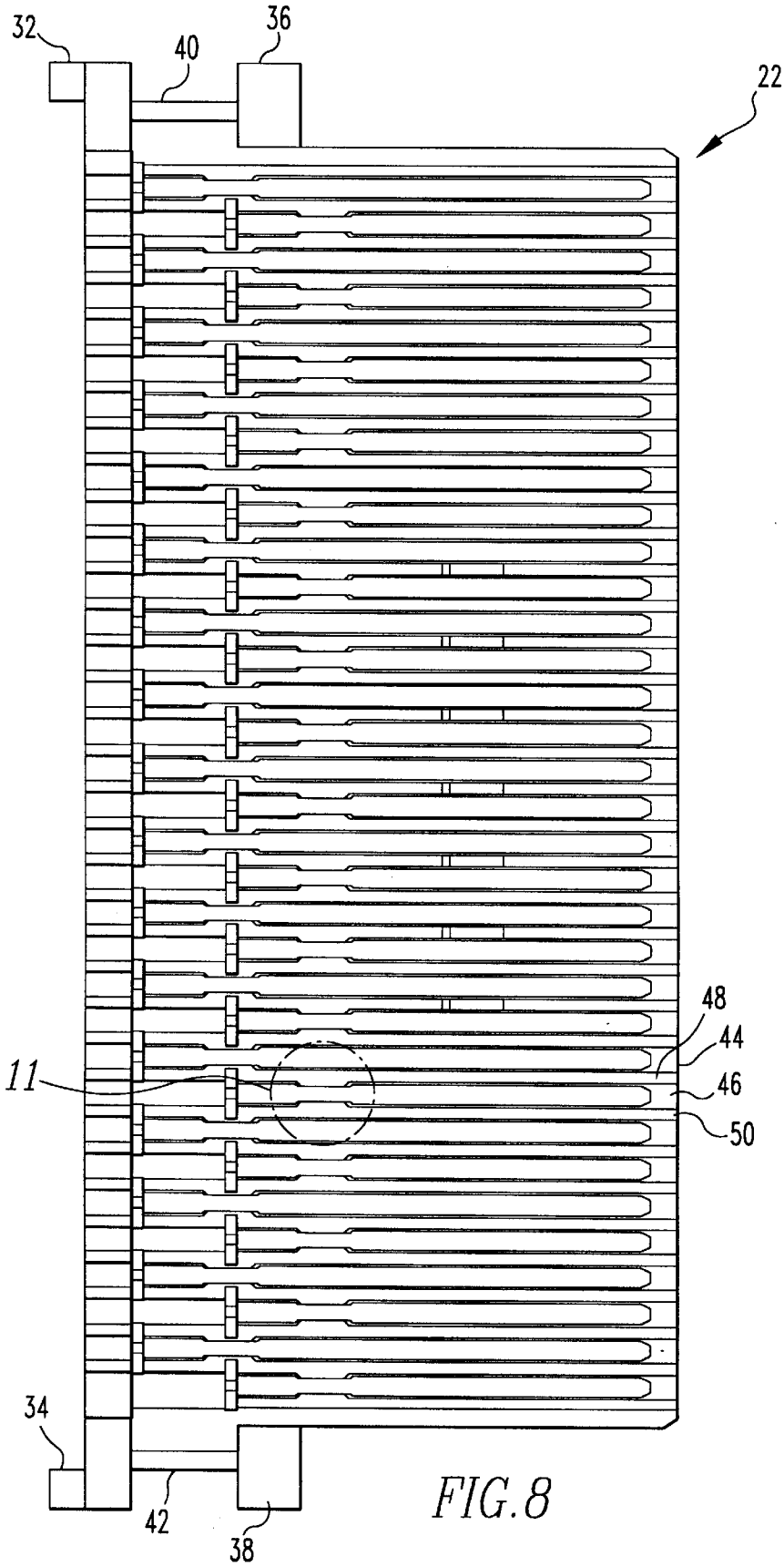
FIG. 8 is a top plan view of the axial insulative members and terminals shown in FIG. 4.
Figure 10:
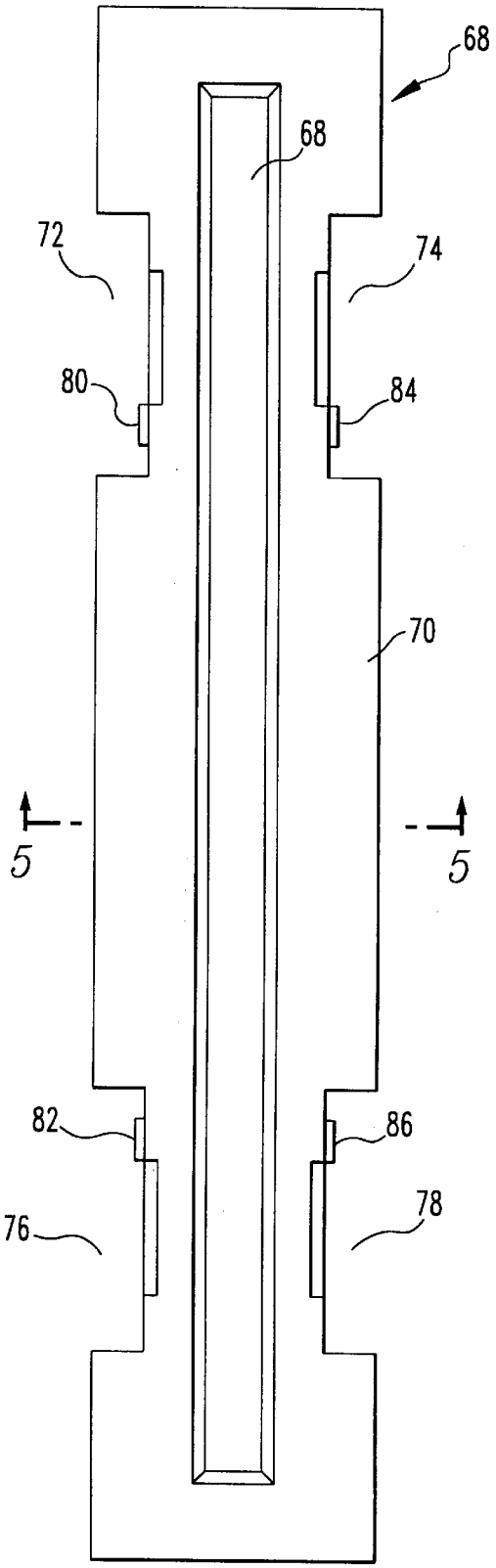
FIG. 10 is a back view of the housing shown in FIG. 9.
Figure 9:
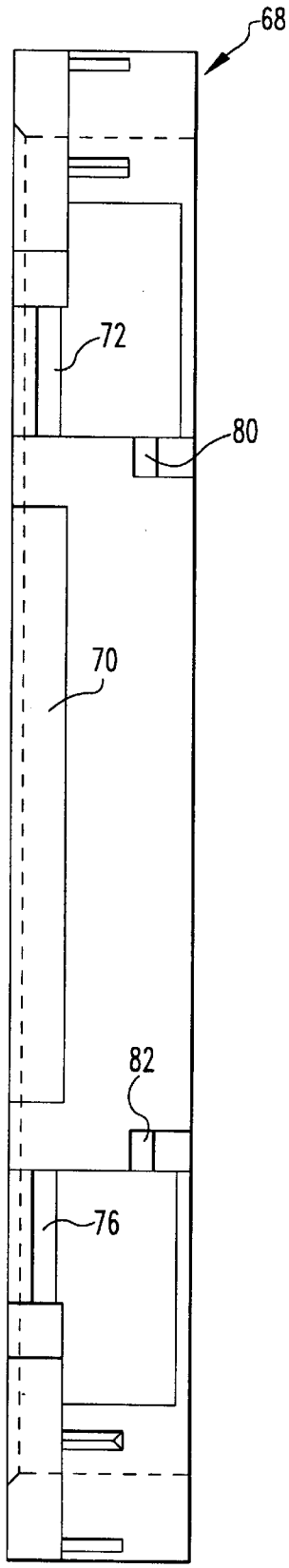
FIG. 9 is a top plan view of the insulative housing shown in FIG. 5.

An axial insulative member used in this connector is shown at numeral 22. This axial insulative member has a planar top surface 24 and a planar bottom surface 26 as well as a front end 28. In opposed relation to the front end 28 there is a rear perpendicular wall 30. At the outer opposed ends of the rear perpendicular wall there are fastener attachments 32 and 34 and stops 36 and 38. Latching ledges 40 and 42 are interposed between the stops 36 and 38 and the rear terminal wall 30. On the planar top surface 24 of the axial insulative member 22, there are plurality of parallel axial grooves as at groove 44 and 46. Adjacent to each of these grooves there are a plurality of axial plastic walls as at wall 48 and wall 50. To retain the terminals as at terminal 10 in these grooves there are lateral extensions as at extension 52 on wall 48 and 54 on wall 50. These extensions engage a narrowed portion as at portion 55 on the terminals. Extending upwardly from each of the walls there is a latch as at latch 56 for engagement of a housing as is explained hereafter. On planar bottom surface 26 of the insulative axial section 12 there are other terminals as at terminal 58 and 60 which are similarity positioned in grooves as at groove 62. There are also latches as at latch 64 on the bottom surface 26 for engagement of the housing as is explained hereafter. Referring particularly to FIGS. 5 and 9–10, the insulative housing element is shown generally at numeral 66. This housing has a central slot 68 and a peripheral wall 70 which has recesses 72, 74, 76 and 78. On the top of the housing there are top latches 80 and 82, and on the bottom of the housing there are bottom latches 84 and 86. The assembly of the connector, the axial insulative member 22 with attached terminals as is shown in FIG. 4 is inserted from its front terminal end 28 into the slot 68 of the housing 66. The latches on the axial insulative member such as latch 54 and 56 serve to retain the insulative housing 66 on the axial insulative member 22 as is shown in FIGS. 1 and 6. Referring to FIG. 7, a metallic shield 88 having a front opening 22 is secured to the connectors by means of the axial housing top latches 80 and 82 and bottom latches 84 and 86.

Figure 12:
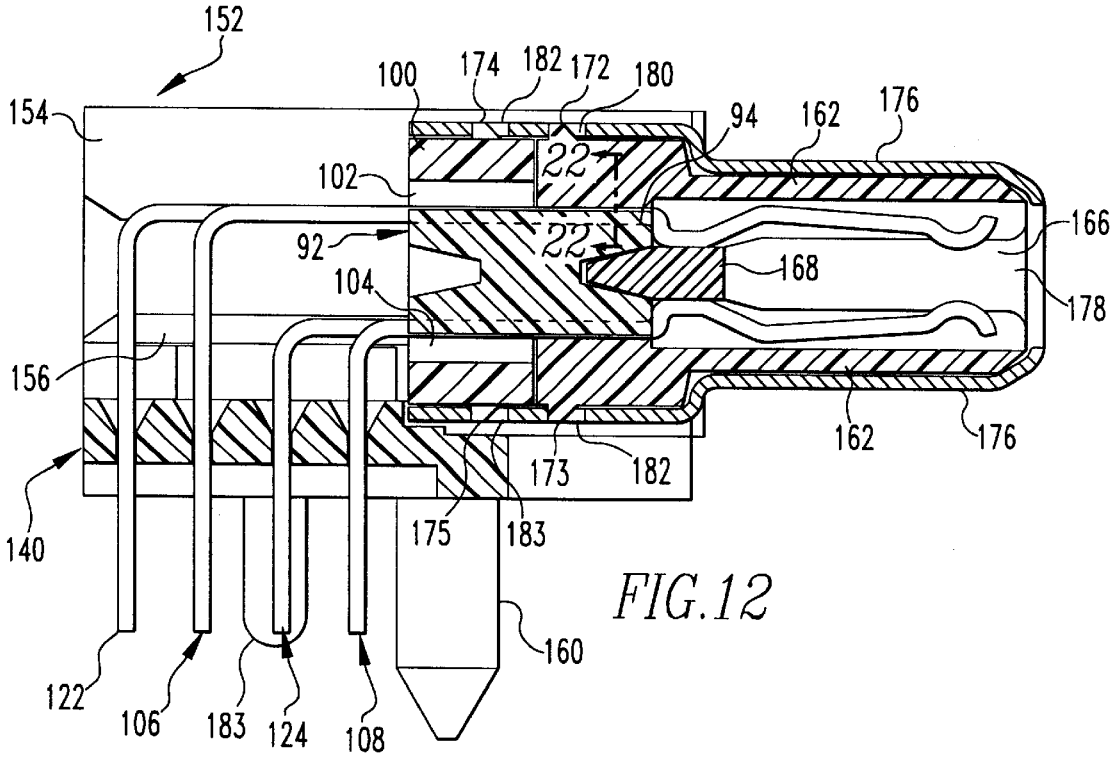
FIG. 12 is a vertical cross sectional view of a second preferred embodiment of the micro miniature connector of the present invention.
Figure 14:
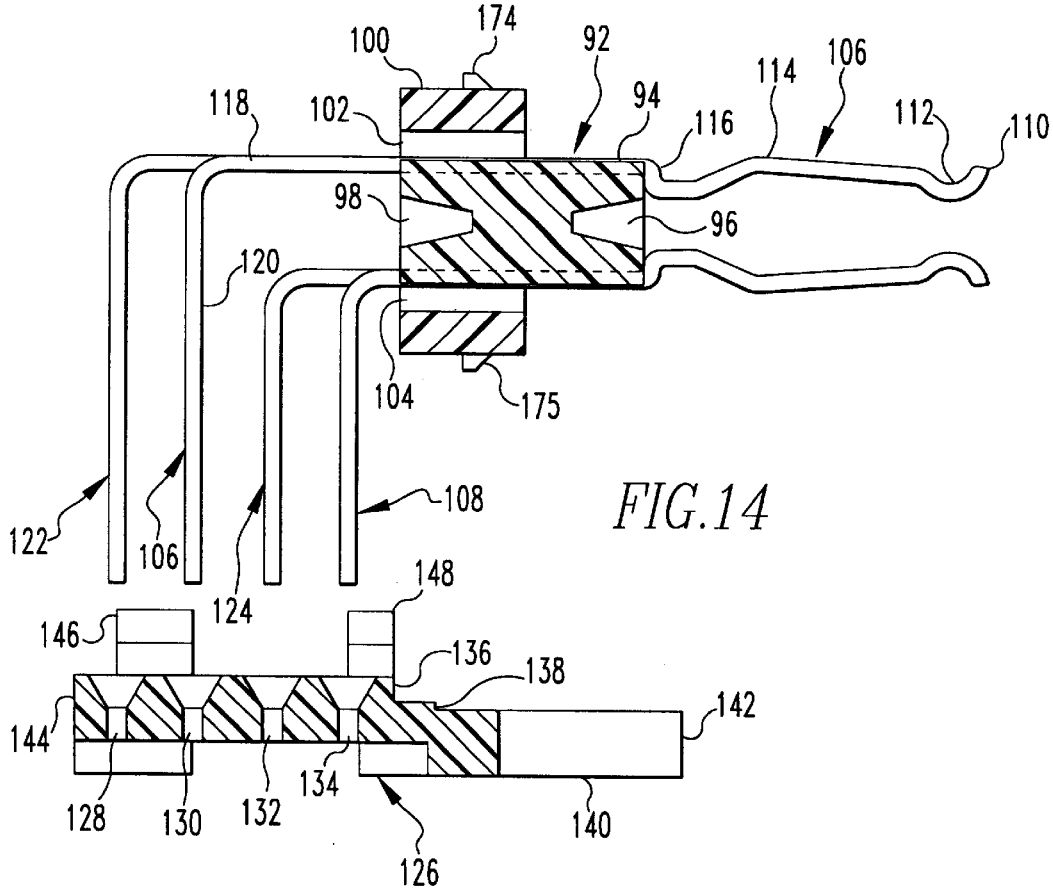
FIG. 14 is a vertical cross sectional view of the axial insulative member shown in FIG. 12 along with a molded wafer in a subsequent step in the manufacture of the connector shown in FIG. 12.
Figure 13:
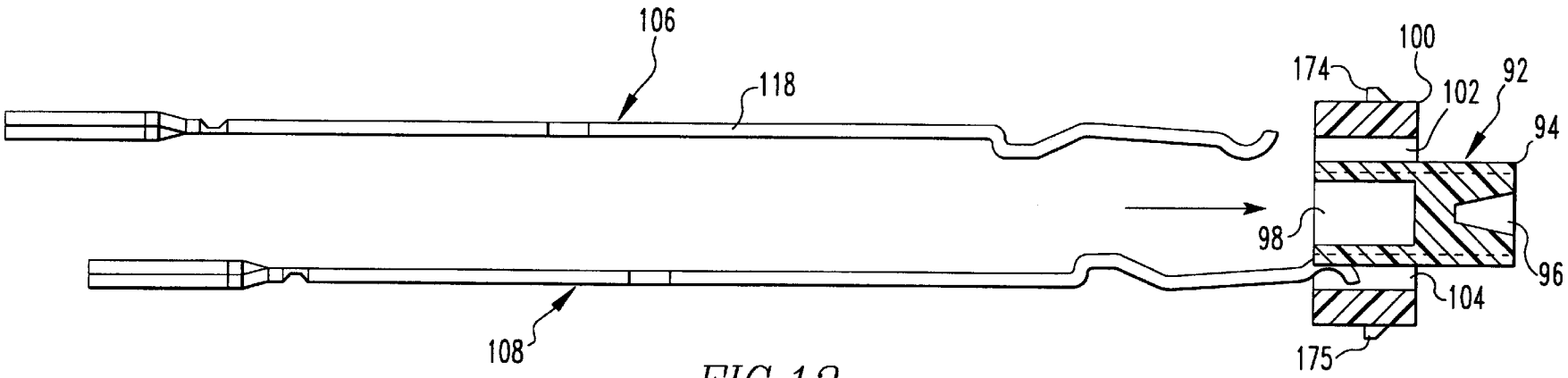
FIG. 13 is a vertical cross sectional view of an axial insulative member used in the connector shown in FIG. 12 along with a pair of conductive terminals for insertion therein.
Figure 16:
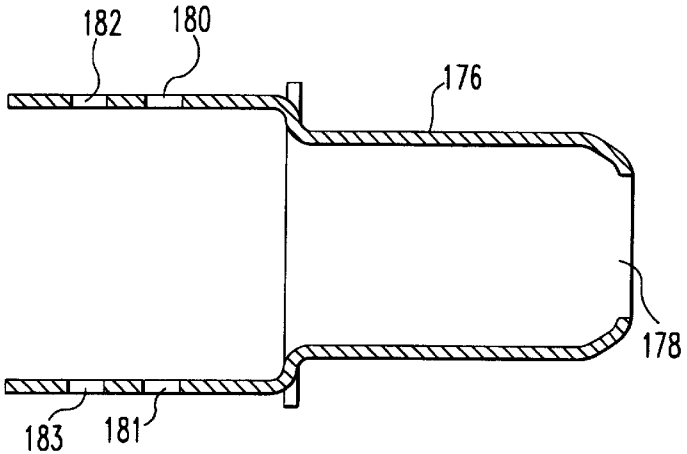
FIG. 16 is a vertical cross sectional view of a metallic shell used in the connector shown in FIG. 12.

A preferred embodiment of the receptacle element of the connector of the present invention is shown in FIGS. 12–24. Referring particularly to FIGS. 13–14, an insulative axial terminal receiving block is shown generally at numeral 92. This terminal block includes a central elongated body 94 having a front recess 96 and a rear recess 98. Extending radially from the central elongated body 94 there is a rear expanded section 100. This rear expanded section 100 has an upper axial slot 102 and a lower axial slot 104. Terminals 106, 108 are inserted, respectively, in the upper axial slot 102 and the lower axial slot 104. Each terminal as, for example, terminal 106 has a forward terminal end 110 adjacent to an inward concave bend 112 which is itself adjacent to an outward concave bend 114 which is adjacent to a terminal block engagement bend 116. Each terminal also has a medial linear section 118 and a downward extension 120. Referring particularly to FIG. 14, it will be seen that in addition to terminals 106 and 108 a connector also includes additional terminals such as terminal 122 and terminal 124. All these terminals engage a molded insulated wafer shown generally at numeral 126. This wafer has a plurality of vertical terminal receiving apertures such as apertures 128, 130, 132 and 134. These apertures receive, respectively, terminals 122, 106, 124 and 108. The wafer also is characterized by vertical steps 136 and 138 and a forward section 140. The wafer also has lateral vertical sections such as forward wall 142 and rearward wall 144. Extending upwardly from the wafer to engage a molded housing as will be explained hereafter there are vertical latches 146 and 148.

Figure 15:
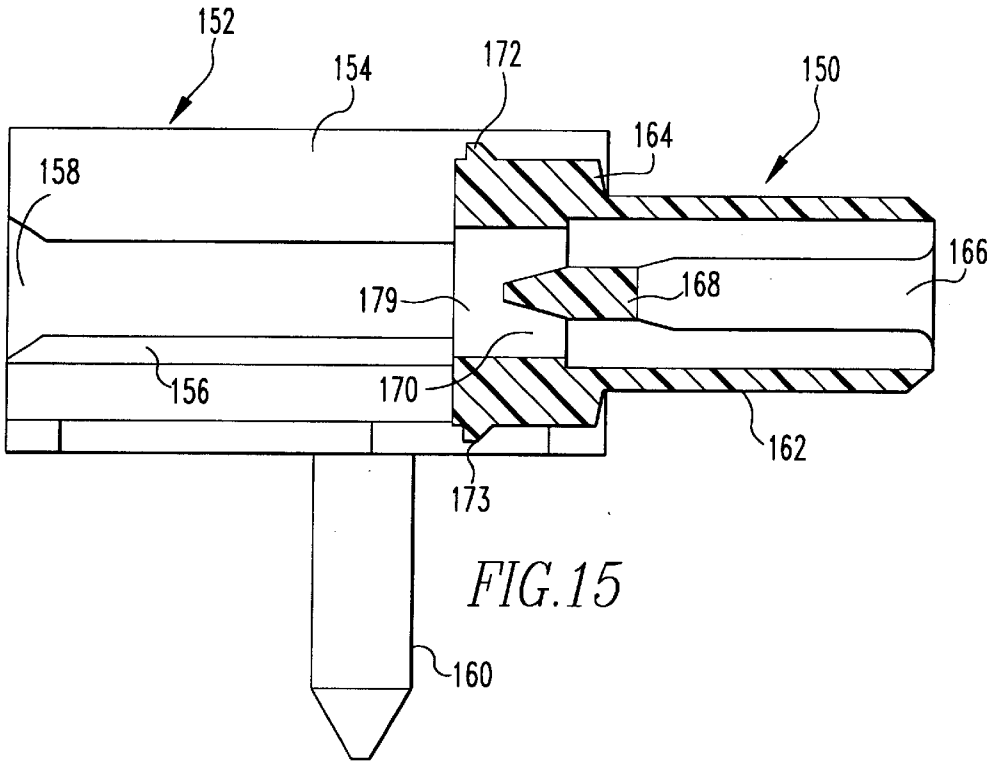
FIG. 15 is a molded insulative housing used in the connector shown in FIG. 12.

Referring particularly to FIG. 15, the receptacle also includes a molded insulative housing shown generally at numeral 150. This housing includes a lateral wall shown generally at numeral 152 made up of an upper section 154, a lower section 156 and a medial recessed section 158. The configuration of this lateral wall serves to engage the terminal block 92 at its ends. The molded housing also includes a locating pin 160 and a forward tubular section 162 which has a rearward radially expanded section 164. At its front the molded housing has a forward recess 166 with a rearwardly pointed recess base 168 which forms an annular space 170 for the front sections of the contacts as at 106 and 108. On the radially expanded section 164 of the forward tubular section 162 there are latches as at latch 172 and 173. There are also latches as at 174 and 175 on the terminal block 92. A metal shell 176 having a forward open end 178 and a rear axial opening 179 is retained on the receptacle by means of the latches 172 and 173 which engage lateral latch receiving apertures as at apertures 180 and 181 and by means of latches 174 and 175 which engage lateral latch receiving apertures 182 and 183. The receptacle may be retained on a printed circuit board (PCB) (not shown) by means of hold downs as at hold down 183.

Figure 17:
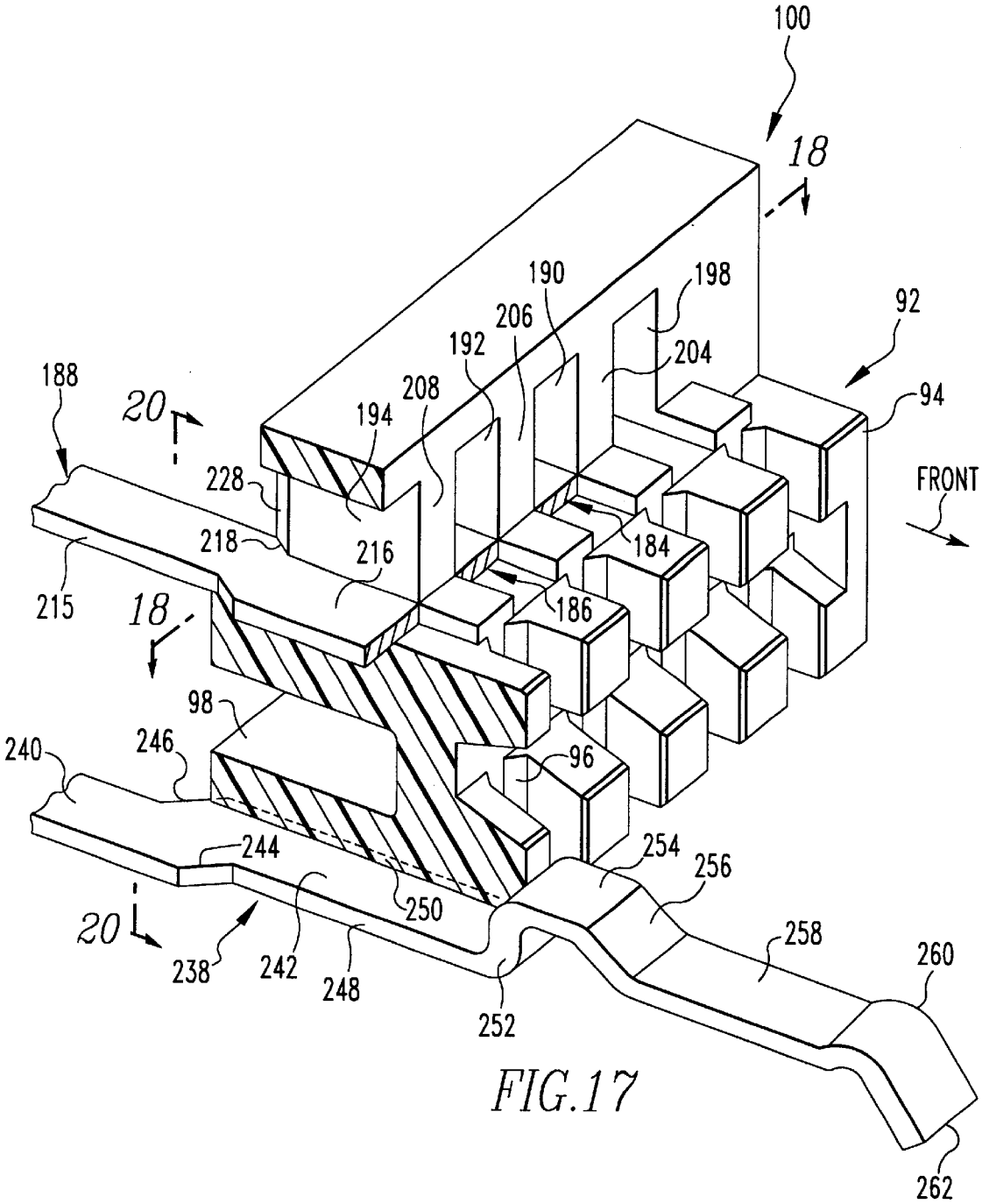
FIG. 17 is a cutaway perspective view of part of the terminal blocks and engaging terminals of the connector element shown in FIG. 12.
Figure 19:
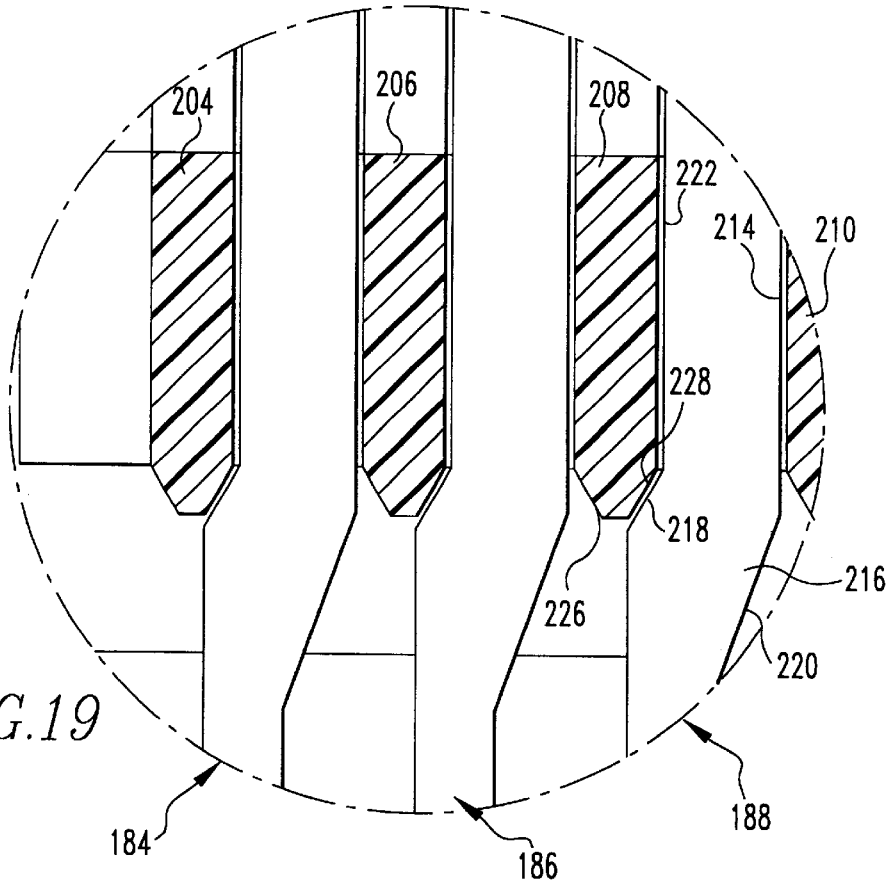
FIG. 19 is an enlarged view of circle 19 in FIG. 18.
Figure 18:
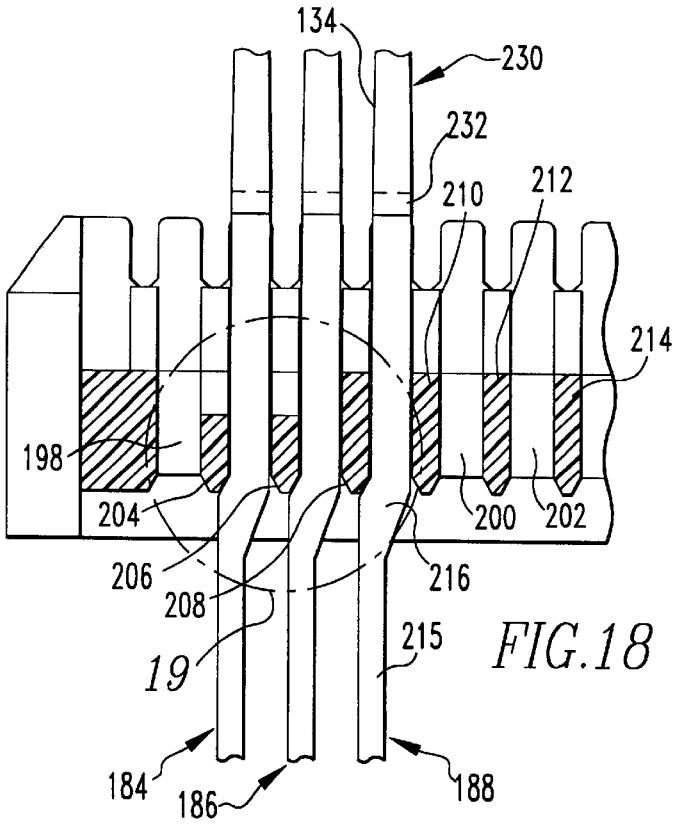
FIG. 18 is a cross sectional view through 18—18 in FIG. 17.

Referring to FIGS. 17–19, a particularly preferred mode of fixing the terminals to the terminal block is illustrated. Referring particularly to FIG. 17, the terminal block 92 having an elongated body 94 and a rear expanded section 100 it is engaged by a plurality of terminals. Referring again particularly to FIG. 17–19, three terminals 184, 186 and 188 are illustrated. These terminals are positioned respectively in slots 190, 192 and 194. It will be seen that there are a plurality of other slots as at slot 198, 200 and 202. It will be understood that for the purpose of clarity only three terminals are illustrated, but in practice each of these slots will receive a terminal. Between the slots there are medial plastic walls as at walls 204, 206, 208, 210 and 212. Each of the terminals as, for example, terminal 188 has a narrowed rear section 215 and a widened medial section 216 positioned in the terminal block. This widened medial section has a minor oblique side 218, a major oblique side 220, and parallel longitudinal sides 222 and 224. Each of the walls as, for example, wall 208 has oblique rear sides 226 and 228. These oblique sides of the wall are abutted by one of the minor oblique sides of the terminal as, for example, minor oblique side 218 of terminal 188 abuts oblique side 228 of wall 208. Each of the terminals also has a front section as, for example, front section 230 on terminal 188. This front section has a generally vertical downward section 232 which abuts the front face of the terminal block 92. Outwardly from the downward section 232 there is a substantially horizontal section 234. While the rest of the upper terminal 188 is not shown, it will be understood that the upper terminals are mirror images of, but otherwise essentially identical to, the lower terminals which are described below. Referring particularly again to FIG. 17, the entire terminal is shown in lower terminal 238. This lower terminal has a narrowed rear section 240, a widened medial section 242 which has a minor oblique side 244 and a major oblique side 246. The medial section also has parallel longitudinal sides 248 and 250. Outwardly from the medial section there is a generally vertical upward section 252 which abuts the front face of the terminal block 92. Outwardly from the vertical section 252 there is a substantially horizontal section 254 then a downwardly oblique section 256, then another substantially horizontal section 258 and then an arcuate section 260 with a terminal end 262. It will be understood that all the terminals have this general configuration with the upper terminals being essentially placed to be in a mirror image of the lower terminals.

Figure 20:
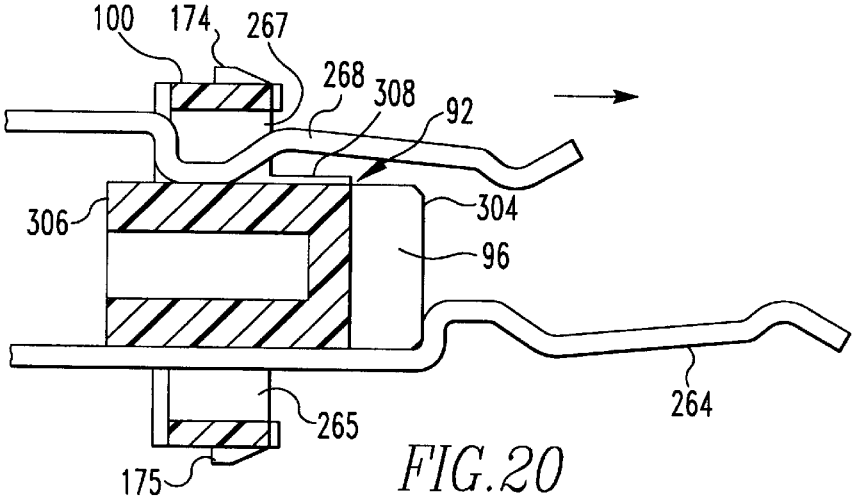
FIG. 20 is a cross sectional view of the terminal block as through 20—20 in FIG. 17 with one terminal partially engaged.
Figure 21:
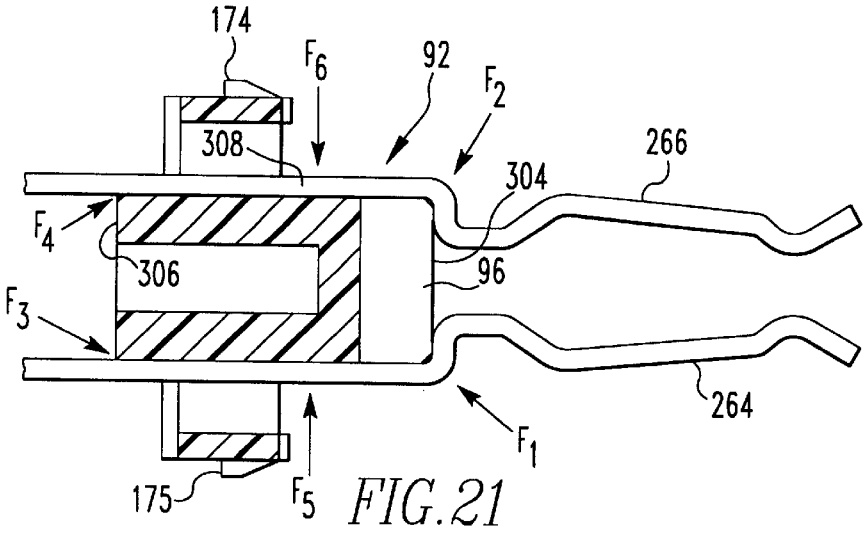
FIG. 21 is a view of the terminal block similar to FIG. 20 wherein both upper and lower terminals are engaged.

Referring to FIGS. 20 and 21, the insertion of the terminals into the terminal block is illustrated. Here it is illustrated that a terminal such as 264 is inserted through a slot as at 265 in the rear section 100 of the terminal block 92. In FIG. 20 an upper terminal 266 is in a transitional position being inserted through a slot 267 in the rear section 100 of the terminal block 92. In FIG. 21 the upper terminal has been inserted to position 266 such as the vertical abuts the front face of the terminal block 92. Still referring to FIG. 21, it will be appreciated that this engagement of the terminals with the front face of the terminal block results in a retaining force or force components as at $F_1$ and $F_2$ respectively on the terminals 264 and 266. On the rear opposed side of the terminal block the interaction of the minor oblique surface abuts the oblique surface of the medial wall. Forces or force components on terminals 264 and 266 as at $F_4$ and $F_5$ respectfully are created to retain the terminals in position at the rear of the terminal block. Referring additionally to FIG. 12, it will also be appreciated that the molded insulative housing 150 bears against the terminals from the outer side of the terminal block to create inward radial forces or force components on terminals 264 and 266 as at $F_5$ and $F_6$ to further retain the terminals in position.

Figure 22:
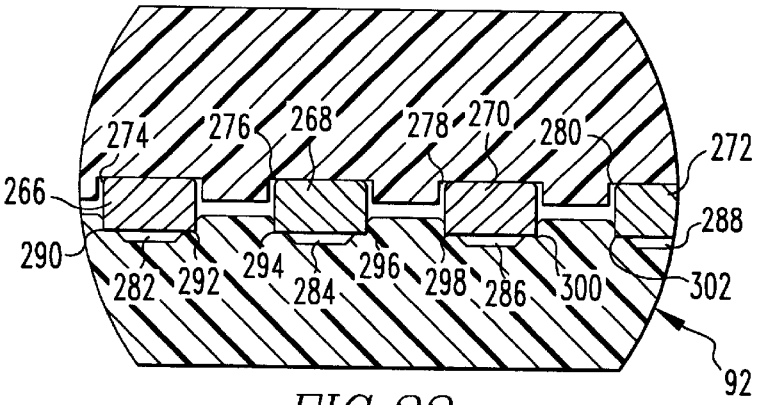
FIG. 22 is a cross sectional view through 22—22 in FIG. 12 showing details of the finalized engagement of the terminals with the molded insulative housing and the terminal block and the connector elements shown in FIG. 12.
Figure 23:
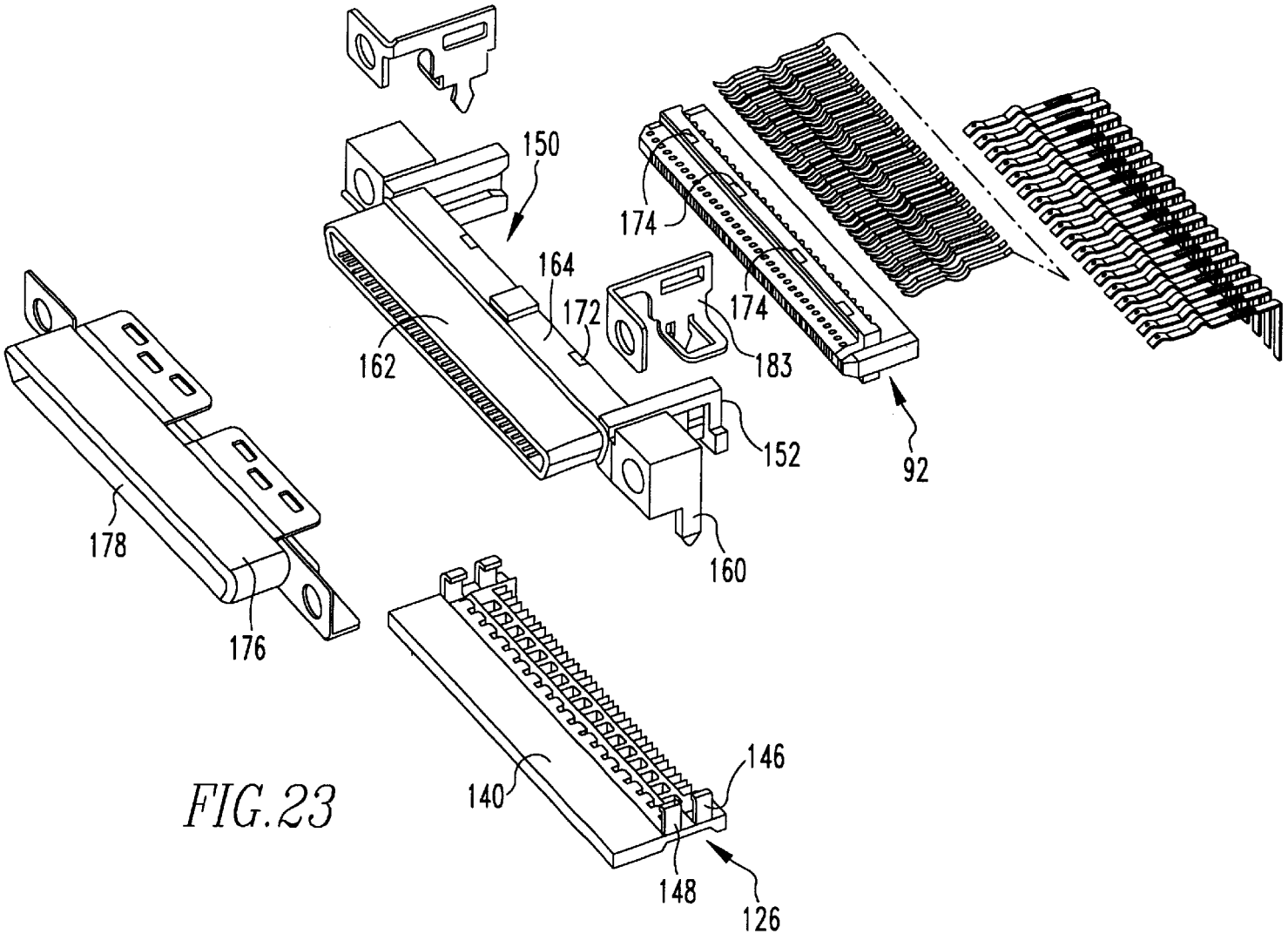
FIG. 23 is an exploded top front perspective view of the connector element shown in FIG. 12.
Figure 24:
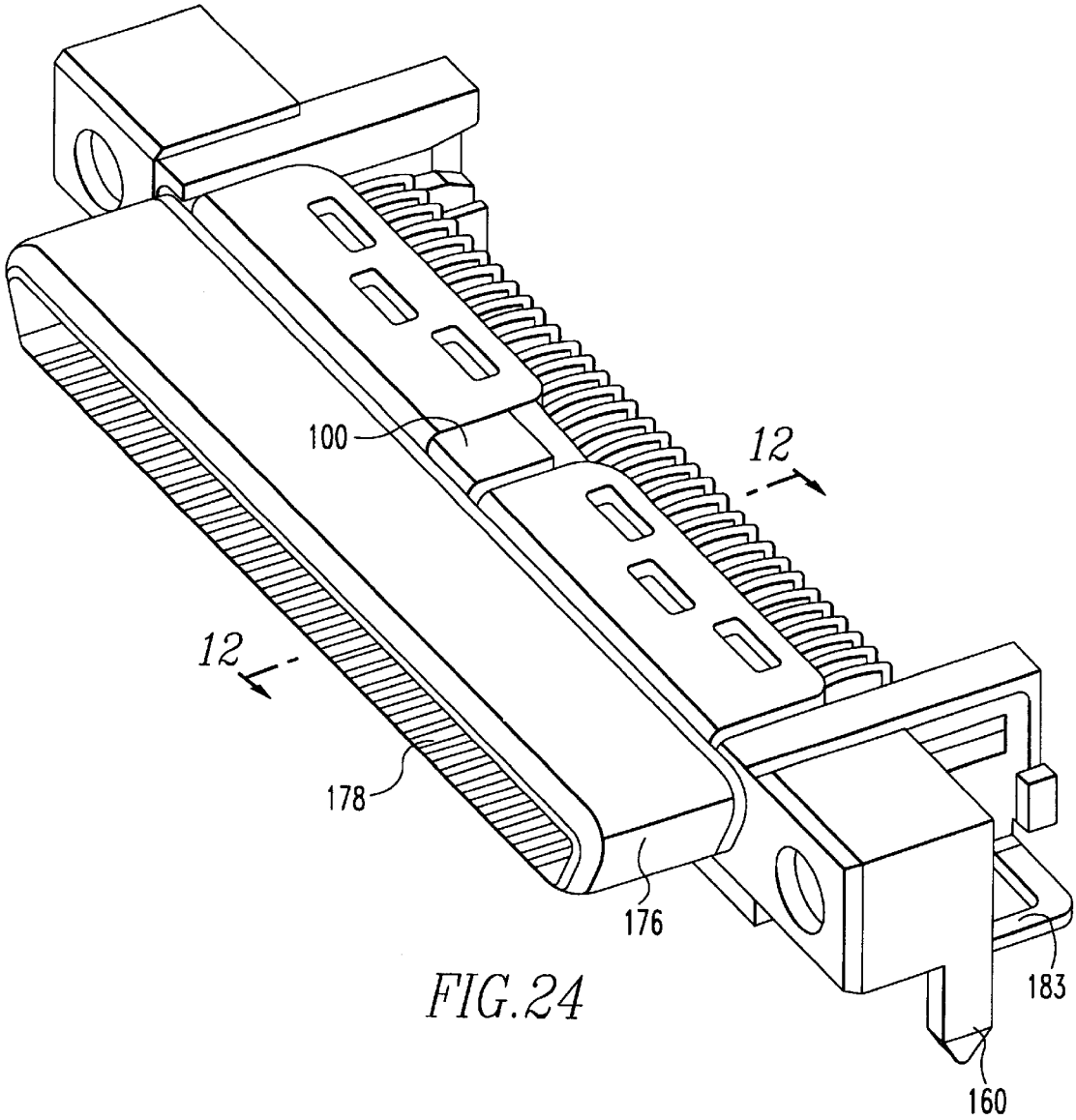

Referring to FIG. 22, it will be seen that the terminals as at terminal 266 are interposed between the molded insulating housing 150 and the terminal block 92. In addition to terminal 266 there are other parallel terminals 268, 270 and 272. These terminals are respectively positioned in grooves 274, 276, 278 and 280 on the inner surface of the molded insulating housing 150. These terminals are also positioned respectfully in the joining grooves 282, 284, 286 and 288 in the terminal block 92. These corners 290 and 292 on the metallic terminals dig into and become emplaced in the plastic in the terminal block to further secure the terminal in position. Similarily terminal 268 has corners 294 and 296 which dig into and become emplaced in the plastic of the terminal block 92 and terminal 270 has corners 298 and 300 which perform a similar function. Terminal 272 also has a corner 302 and another corner (not shown) which also dig into and become emplaced in the plastic in terminal block 92 to further secure these terminals in position.

Referring again to FIGS. 20 and 21 and for the purpose of orientation, the front end of the terminal block 42 which is inserted into the rear axial opening 179 (FIG. 15) of the molded insulation housing 150 (FIG. 15) is the distal end 304. The opposed rear end of the terminal block 92 is referred to as to proximate end 306, and a medial section 308 is interposed between the distal end 304 and proximate end 306. The forces or force components $F_1$ and $F_2$ are applied at or adjacent to the distal end 304. The forces or force components $F_3$ and $F_4$ are applied at or adjacent to the proximate end 306. The force or force components $F_5$ and $F_6$ are applied at or adjacent to the medial section.

It will be appreciated that a micro miniature electrical connector and a method for its manufacture have been disclosed which allows for a low cost non-barbed connector that can be manufactured without insert molding and which maintains the functional characteristics of the prior art barbed, insert molded connectors.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method of assembling an element of an electrical connector comprising the steps of:

(a) providing an axial insulative member having at least one axial slot for retaining a terminal;

(b) providing a conductive terminal having a rearward extension projecting generally perpendicularly therefrom and positioning said conductive terminal in the slot, wherein a first portion of the terminal engages the axial insulative member to prevent the first portion from moving in a first direction, a second portion of the terminal generally orthogonal to the first portion engages an end of the axial insulative member to prevent the second portion from moving in a second direction reverse to the first direction, and a third portion of the terminal is located in the slot, wherein the first, second and third portions extend in different directions generally transverse to each other, wherein the first portion is in a same plane as the third portion and extends in an oblique from the third portion, wherein the second portion extends out of the same plane, and wherein the first and second directions include forward and rearward directions on the axial insulative member; and (c) providing an insulative housing having a peripheral wall and an axial opening and inserting the axial insulative member into the axial opening of said insulative housing member, wherein the housing contacts the third portion in the slot such that the conductive terminal is fixed in the slot.

2. The method of claim 1 wherein the at least one slot comprises a plurality of slots.

3. The method of claim 2 wherein there are a plurality of conductive terminals.

4. The method of claim 3 wherein each of the slots has a conductive terminal mounted in it.

5. The method of claim 4 wherein there are a plurality of additional conductive terminals and one of said conductive terminals is mounted in each of the slots.

6. The method of claim 5 wherein each of said additional conductive terminals has a rearward extension projecting perpendicularly therefrom.

7. The method of claim 6 wherein each of the conductive terminals has at least one adjacent conductive terminal and the rearward extensions of each of said conductive terminals and its adjacent terminal are axially spaced.

8. The method of claim 7 wherein the rearward extensions of the conductive terminals are insulation displacement contacts.

9. The method of claim 7 wherein the axial insulative member has a rear generally perpendicular wall.

10. The method of claim 4 wherein in the axial insulative member there is a terminal attachment point in each of the grooves and adjacent each of said grooves there is a wall and adjacent said terminal attachment point said wall increases in thickness.

11. The method of claim 9 wherein adjacent the terminal attachment point each of said terminals decreases in width.

12. The method of claim 11 wherein on at least some of the axial walls there are perpendicular latches and said perpendicular latches engage the insulative housing.

13. The method of claim 4 wherein a metallic shell surrounds at least part of the axial insulative member and the insulative housing.

14. The method of claim 4 wherein the axial insulative member and the slots of the housing are transversely elongated.

15. The method of claim 1 wherein the opening of the insulative housing is a slot.

16. The method of claim 1 wherein the element of the electrical connector is a receptacle.

17. An element of an electrical connector comprising:

(a) an axial insulative member having at least one axial slot for retaining a terminal;

(b) a conductive terminal having a rearward extension projecting generally perpendicularly therefrom, the terminal being positioned in the slot with a first portion of the terminal contacting a first end surface of the axial insulative member, a second portion of the terminal contacting an opposite second end surface of the axial insulative member, and a third portion of the terminal between the first and second portions being located in the slot, wherein the first, second and third portions extend in different directions generally transverse to each other, wherein the first portion is in a same plane as the third portion and extends in an oblique from the third portion, wherein the second portion extends out of the same plane, and wherein the first and second portions are generally angled relative to each other; and (c) an insulative housing having a peripheral wall and axial opening, wherein the axial insulative member is inserted into the axial opening of said insulative housing, wherein the housing contacts the third portion of the terminal such that the conductive, terminal is fixed in the slot.

18. The element of an electrical connector of claim 17 wherein the at least one slot comprises a plurality of slots in the axial insulative member.

19. The element of an electrical connector of claim 17 wherein said element is a receptacle.

20. An electrical connector comprising:

a first insulative member having an opening;

a second insulative member inserted into the opening of the first member; and an electrical contact having a middle portion located in a slot of the second member and sandwiched between the first and second members, wherein the contact comprises section located at opposite ends of the middle portion located outside the slot which extend from the middle portion located directions transverse to a longitudinal axis of the middle portion and contact portions of the second insulative member, wherein the section extend in different directions generally transverse to each other, wherein a first one of the section is in a same plane as the middle portion and extends in an oblique from the middle portion, and wherein a second one of the sections extends out of the same plane.

21. An electrical connector as in claim 20 wherein the slot has a substantially uniform cross-section along its length.

* * * * *